US007659878B2

(12) United States Patent
Endou et al.

(10) Patent No.: US 7,659,878 B2
(45) Date of Patent: Feb. 9, 2010

(54) DISPLAY CONTROL DEVICE

(75) Inventors: Shinji Endou, Yamagata (JP); Takayuki Doi, Tokyo (JP)

(73) Assignee: NEC Electronics Corporation, Kanagawa (JP)

( * ) Notice: Subject to any disclaimer, the term of this patent is extended or adjusted under 35 U.S.C. 154(b) by 502 days.

(21) Appl. No.: 11/619,977

(22) Filed: Jan. 4, 2007

(65) Prior Publication Data

US 2007/0152946 A1 Jul. 5, 2007

(30) Foreign Application Priority Data

Jan. 5, 2006 (JP) ..... 2006-000946

(51) Int. Cl.
*G09G 3/36* (2006.01)

(52) U.S. Cl. ..... 345/100; 345/98

(58) Field of Classification Search ..... 345/83–100, 345/204

See application file for complete search history.

(56) References Cited

U.S. PATENT DOCUMENTS 6,774,833 B2 * 8/2004 Tanaka ..... 341/144
6,989,810 B2 * 1/2006 Morita ..... 345/98
7,180,496 B2 * 2/2007 Koyama et al. ..... 345/98
7,190,297 B2 * 3/2007 Koyama et al. ..... 341/144
2004/0178978 A1 * 9/2004 Koyama et al. ..... 345/89
2004/0257328 A1 12/2004 Lim
2005/0162371 A1 * 7/2005 Morita ..... 345/98
2006/0098003 A1 * 5/2006 Koyama et al. ..... 345/204
2007/0164961 A1 * 7/2007 Koyama et al. ..... 345/92
2007/0216631 A1 * 9/2007 Nojiri ..... 345/100
2009/0066678 A1 * 3/2009 Tanaka ..... 345/204

FOREIGN PATENT DOCUMENTS

JP 2004-301513 A 10/2004

* cited by examiner

*Primary Examiner*—Nitin Patel
(74) *Attorney, Agent, or Firm*—Sughrue Mion, PLLC

(57) ABSTRACT

A display control device has: a shift register generating n shift pulses in series; a data hold block configured to hold n gradation data; and a DA converter for converting the n gradation data into corresponding gradation voltages. The data hold block includes: n first latch circuits configured to respectively latch the n gradation data in series in synchronization with the n shift pulses; and n second latch circuits provided between the DA converter and the n first latch circuits. An electrical connection between the first latch circuits and the second latch circuits is cut off while the first latch circuits receive the n gradation data. After the first latch circuits finish latching all the gradation data, the n gradation data are simultaneously supplied to the DA converter from the first latch circuits through the second latch circuits.

8 Claims, 15 Drawing Sheets

DISPLAY CONTROL DEVICE

BACKGROUND OF THE INVENTION

1. Field of the Invention

The present invention relates to a display control device for controlling a display.

2. Description of the Related Art

A display such as an active-matrix liquid crystal display and the like is publicly known. A display control device is used for controlling image representation on the display. FIG. 1 is a block diagram schematically showing a configuration of a conventional display control device used in the liquid crystal display. FIG. 2 is a timing chart showing an operation of the display control device shown in FIG. 1. FIG. 3 is a circuit diagram showing a configuration of a typical D flip-flop. The conventional display control device will be described below with reference to FIGS. 1 to 3.

As shown in FIG. 1, the display control device is provided with a shift register 1, a data hold block 4, a DA converter (DAC) 5 and an amplifier circuit (AMP) 6. The data hold block 4 includes a data register 2 and a data latch 3.

The shift register 1 has n (n is a natural number) D flip-flops that are connected in series. A clock signal is input to each D flip-flop. When one start pulse is input to the shift register 1 from the outside, the pulse is shifted through the D flip-flops in series in synchronization with the clock signal. The serially shifted pulse is referred to as a "shift pulse" hereinafter. As shown in FIG. 1, n shift pulses SCLK1 to SCLK(n) respectively output from the n D flip-flops are supplied to the data register 2.

As shown in FIG. 2, the shift pulses SCLK1 to SCLK(n) are output in series. In this manner, the shift register 1 outputs the shift pulses SCLK1 to SCLK(n) in series to the data register 2 based on the start pulse and the clock signal.

The data hold block 4 receives gradation data and a strobe signal in addition to the shift pulses SCLK1 to SCLK(n) output from the shift register 1. The gradation data are digital data corresponding to an image displayed on a liquid crystal panel of the liquid crystal display. As shown in FIG. 2, n gradation data (0Ah, 0Bh . . . ) corresponding to source outputs S1 to Sn are input in series to the data hold block 4.

More specifically, the data register 2 of the data hold block 4 has n D flip-flops. The n gradation data and the shift pulses SCLK1 to SCLK(n) are input to the n D flip-flops, respectively.

Each D flip-flop has a configuration as shown in FIG. 3, and receives a corresponding shift pulse as a clock signal. As shown in FIG. 2, the D flip-flops respectively hold the gradation data in response to the falling edges of the respective shift pulses SCLK1 to SCLK(n). That is, the data register 2 takes in the respective gradation data in synchronization with the shift pulses SCLK1 to SCLK(n). It should be noted that each gradation data is a data of plural bits, and each D flip-flop has the same bus width as each gradation data (not shown).

The data latch 3 of the data hold block 4 has n D flip-flops. The n D flip-flops are connected to outputs of the n D flip-flops of the data register 2, respectively. The strobe signal is input to the n D flip-flops of the data latch 3. Each D flip-flop is configured to receive data in response to the rising edge of the strobe signal. The strobe signal rises after all the gradation data are held by the data register 2, as shown in FIG. 2. In response to that, the data latch 3 receives simultaneously the all gradation data held by the data register 2.

The DA converter 5 receives the all gradation data from the data latch 3. Then, based on a reference voltage, the DA converter 5 converts respective gradation data into corresponding gradation voltages. The DA converter 5 outputs to the amplifier circuit 6 the gradation voltages corresponding to the respective gradation data. The amplifier circuit 6 amplifies the gradation voltages to generate source outputs 7 (output voltages S1 to Sn). Then, the amplifier circuit 6 applies the output voltages S1 to Sn to respective data lines of the liquid crystal panel.

In recent years, there is an increasing demand for a larger number of gradations in the liquid crystal display. In a case where the number of gradations is increased from 6 bits to 9 bits, for example, each of the data register 2, the data latch 3 and the DA converter 5 shown in FIG. 1 increases 1.5 times in circuit size. This causes increase in production cost of the display control device.

Moreover, in a test of the data hold block 4, various gradation data are written into the data hold block 4, and then the source outputs 7 output from the amplifier circuit 6 are analyzed. Here, the source outputs 7 include a plurality of output voltages S1 to Sn as described above, and manufacturing variability or the like affects the output voltages S1 to Sn. Even if the same gradation data is written into all the D flip-flops of the data register 2, the analog output voltages S1 to Sn are not always equal to each other due to the manufacturing variability or the like. It is therefore necessary to consider the influence of the manufacturing variability on the output voltages S1 to Sn when analyzing the outputs from the amplifier circuit 6.

FIG. 4A schematically shows an example of the variability of the source outputs 7. Specifically, the output voltages corresponding to the m-th gradation, the (m+1)-th gradation and the (m+2)-th gradation are shown. Each output voltage corresponding to any gradation has a certain distribution due to the manufacturing variability, and a judgment level for judging each gradation (each output voltage) has a certain width. In FIG. 4A, there is no overlap between the judgment levels of adjacent gradations.

However, the difference between the judgment levels of the adjacent gradations is becoming smaller because of the increase in the number of gradations and decrease in an operation voltage. In FIG. 4B, the difference between the judgment levels of the adjacent gradations is smaller than the variability width of the output voltage, and thus there is an overlap between the judgment levels of the adjacent gradations. In this case, it is difficult to determine which of the adjacent gradations corresponds to an output voltage. In other words, it is difficult to test the data hold block 4 by checking the gradation data based on the output voltage. In particular, it is difficult to test the low-order bit of the gradation data.

FIG. 5 shows a waveform of one output voltage output from the amplifier circuit 6. As shown in FIG. 5, the width of the judgment level for judging the output voltage is small. From the aspect of electric power consumption, it is not desirable to enhance drive ability of the amplifier circuit 6. Therefore, a lot of time is necessary for testing the data hold block 4 based on the source output 7 output from the amplifier circuit 6.

Japanese Laid-Open Patent Application JP-P2004-301513 discloses a semiconductor device having a liquid crystal driving circuit and a method of testing the same. The liquid crystal driving circuit is provided with a digital function unit, an analog function unit and a test terminal. The digital function unit and the analog function unit are functionally separated from each other. A test result with respect to the digital function unit is transferred to the test terminal without through the analog function unit and is output to the outside of the liquid crystal driving circuit.

SUMMARY OF THE INVENTION

The present invention has recognized the following points. In the above-mentioned conventional display control device, the D flip-flops are provided in the data hold block 4. FIG. 6 shows a layout of the conventional display control device. As shown in FIG. 6, one pad (PAD), one amplifier circuit (AMP), one DA converter (DAC) and two D flip-flops (DFF) are necessary for one source output. Increase in the layout area of the display control device causes increase in its production cost. In particular, the increase in the number of gradations in recent years results in the increase in the layout area of the display control device. A technique capable of reducing the layout area is desired in order to reduce the production cost. Here, it is particularly effective to make the short side of the layout pattern as small as possible with respect to the long side of the layout pattern.

In an aspect of the present invention, a display control device for controlling a display is provided. The display control device is provided with a shift register, a data hold block and a DA converter. The shift register generates n shift pulses (n is a natural number) in series in synchronization with a clock signal. The data hold block is configured to hold n gradation data that are digital data corresponding to an image displayed on a display panel. The DA converter converts the n gradation data into corresponding gradation voltages respectively.

The data hold block has: n first latch circuits configured to respectively latch the n gradation data in series in synchronization with the n shift pulses; and n second latch circuits provided between the DA converter and the n first latch circuits respectively. An electrical connection between the n first latch circuits and the n second latch circuits is cut off while the n first latch circuits receive the n gradation data respectively. After the n first latch circuits finish latching all of the n gradation data, the n gradation data are simultaneously supplied to the DA converter from the n first latch circuits through the n second latch circuits.

In the display control device according to the present invention, as described above, the latch circuits are employed in the data hold block. As a result, a circuit layout area of the display control device can be reduced, and thereby the increase in its production cost can be suppressed. Even when the latch circuits are employed, the same function as of the D flip-flops can be achieved in the display control device. In other words, it is possible according to the present invention to reduce the circuit layout area and the production cost of the display control device with achieving the conventional function.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposed.

A display control device according to the present invention will be described below with reference to the attached drawings. The display control device is installed in a display such as an active-matrix liquid crystal display and so on. Besides the liquid crystal display, the display is exemplified by an organic EL display or a plasma display. The display control device controls a display panel such as a liquid crystal panel, an organic EL panel, or a plasma display panel (PDP) for displaying an image.

1. First Embodiment

1-1. Configuration

Figure 7:
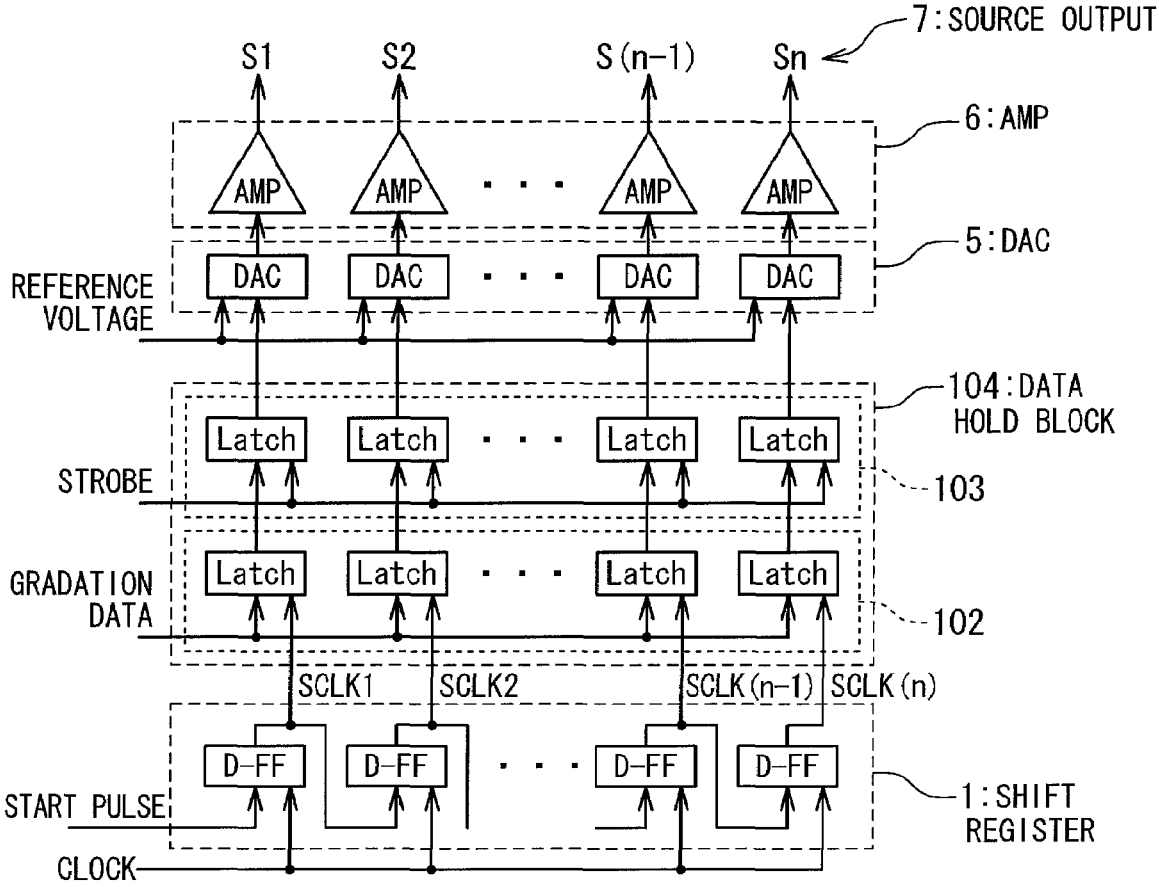
FIG. 7 is a block diagram showing a configuration of a display control device according to a first embodiment of the present invention.

FIG. 7 is a block diagram showing a configuration of a display control device according to a first embodiment of the present invention. The display control device receives gradation data that are digital data corresponding to an image displayed on the display panel. Then, the display control device generates output voltages S1 to Sn (source output 7) corresponding to the received gradation data, and outputs the respective output voltages S1 to Sn to data lines of the display panel.

More specifically, the display control device is provided with a shift register 1, a data hold block 104, a DA converter 5 and an amplifier circuit 6, as shown in FIG. 7. The data hold block 104 is configured to hold the gradation data, and includes a data register 102 and a data latch 103. The shift register 1 is connected to the data register 102 of the data hold block 104. The data register 102 is connected to the data latch 103. The data latch 103 is connected to the DA converter 5, namely, provided between the data register 102 and the DA converter 5. The DA converter 5 is connected to the amplifier circuit 6. The amplifier circuit 6 is connected to the data lines of the display panel.

The shift register 1 has n (n is a natural number) D flip-flops that are connected in series. A clock signal is input to each D flip-flop. When one start pulse is input to the shift register 1 from the outside, the pulse is shifted through the D flip-flops in series in synchronization with the clock signal. The serially shifted pulse is referred to as a "shift pulse" hereinafter. Thus, the shift register 1 generates n shift pulses SCLK1 to SCLK (n) in series in synchronization with the clock signal. As shown in FIG. 7, the n shift pulses SCLK1 to SCLK(n) respectively output from the n D flip-flops are supplied to the data register 102.

The data hold block 104 receives the gradation data and a strobe signal in addition to the shift pulses SCLK1 to SCLK (n) output from the shift register 1. More specifically, the data register 102 of the data hold block 104 has n latch circuits (first latch circuits). Respective gradation data and respective shift pulses SCLK1 to SCLK(n) are input to respective latch circuits. The respective latch circuits latch the respective n gradation data in response to falling edges of the respective shift pulses SCLK1 to SCLK(n). Moreover, the data latch 103 of the data hold block 104 also has n latch circuits (second latch circuits). The n latch circuits are connected to respective outputs of the above-mentioned n latch circuits of the data register 102. The strobe signal is input to the n latch circuits of the data latch 103. It should be noted that each gradation data is a data of plural bits, and each latch circuit has the same bus width as each gradation data (not shown).

Figure 9:
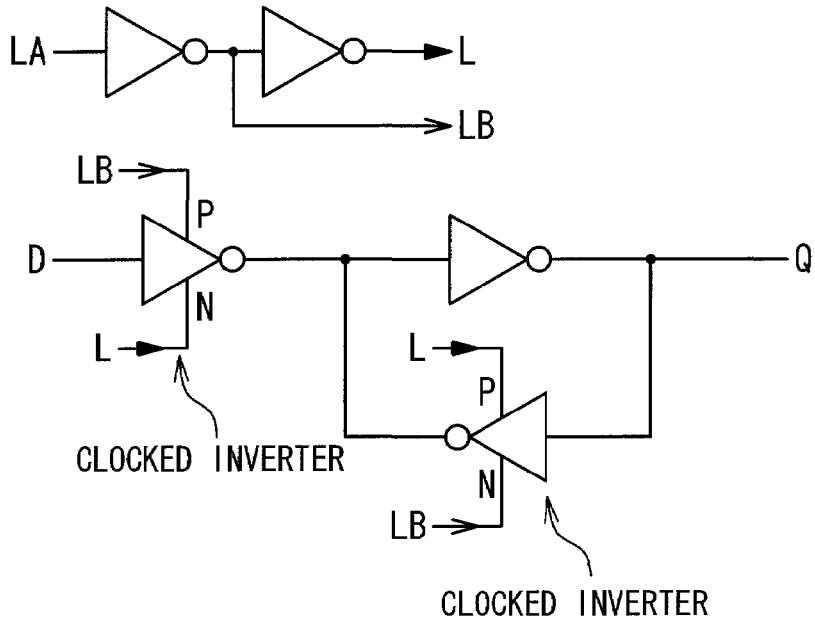
FIG. 9 is a circuit diagram showing an example of a latch circuit used in the present invention.

Each latch circuit of the data register 102 and the data latch 103 has a configuration as shown in FIG. 9, for example. As shown in FIG. 9, one latch circuit has clocked inverters which operate in accordance with control signals L and LB. The control signals L and LB are a non-inverted signal and an inverted signal of a latch signal LA, respectively. When the latch signal LA is "0", the latch circuit latches data input from a data input terminal D (data latch state). On the other hand, when the latch signal LA is "1", data being input through the data input terminal D is directly output from a data output terminal Q (data through state).

As for the data register 102, each of the shift pulses SCLK1 to SCLK(n) is input as the latch signal LA into a corresponding latch circuit. Also, a corresponding gradation data is input to the data input terminal D. That is, each latch circuit of the data register 102 latches the corresponding gradation data in response to a falling edge of the corresponding shift pulse. The data output terminal Q of the latch circuit of the data register 102 is connected to the data input terminal D of the corresponding latch circuit of the data latch 103.

As for the data latch 103, the strobe signal is input as the latch signal LA into the latch circuit. When the strobe signal is "1", an electric connection between the data register 102 and the data latch 103 is established. That is to say, each latch circuit of the data latch 103 receives the gradation data output from a corresponding latch circuit of the data register 102, in response to a rising edge of the strobe signal. Moreover, each latch circuit of the data latch 103 latches the received gradation data in response to a falling edge of the strobe signal. The data output terminal Q of each latch circuit is connected to the DA converter 5.

The DA converter 5 includes a plurality of DA converters (DAC) and receives the all gradation data from the data latch 103. Then, based on a reference voltage, the DA converter 5 converts respective gradation data into corresponding gradation voltages. The DA converter 5 outputs to the amplifier circuit 6 the gradation voltages corresponding to the respective gradation data. The amplifier circuit 6 amplifies the gradation voltages to generate the source outputs 7 (the output voltages S1 to Sn). Then, the amplifier circuit 6 applies the output voltages S1 to Sn to the respective data lines of the liquid crystal panel.

1-2. Operation

Figure 8:
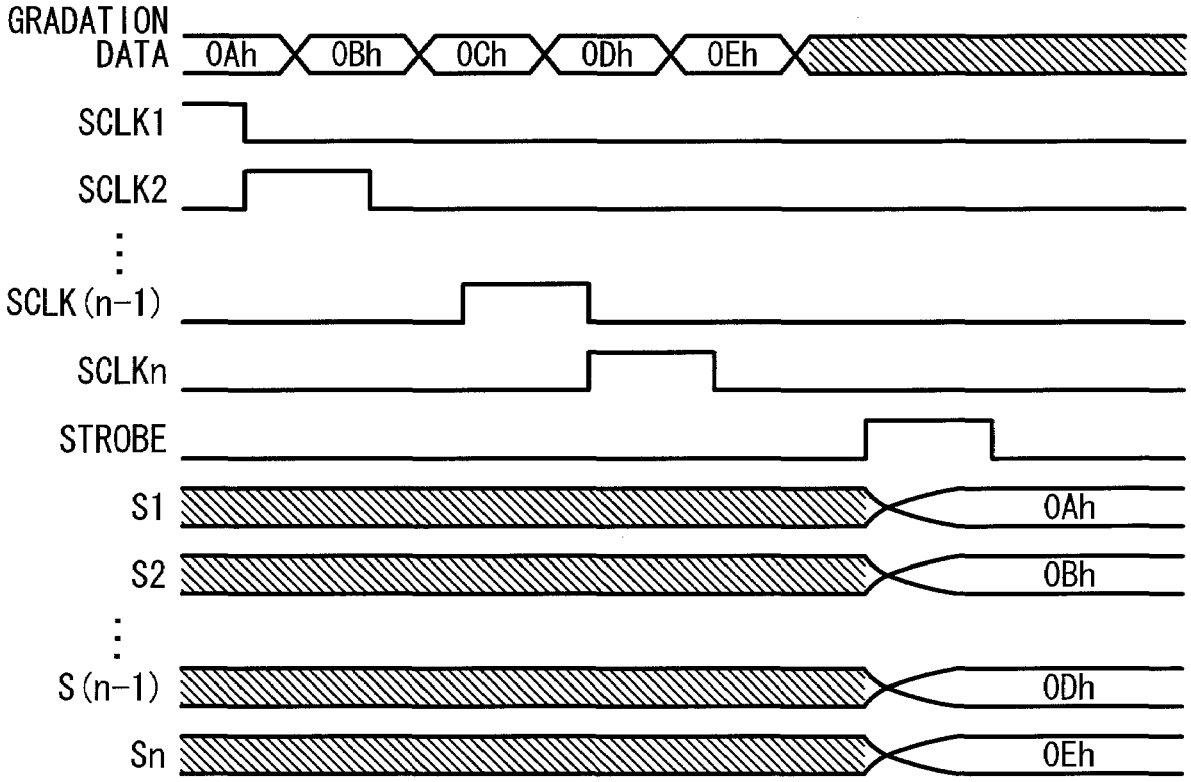
FIG. 8 is a timing chart showing an example of an operation of the display control device according to the first embodiment of the present invention.

FIG. 8 is a timing chart showing an example of an operation of the display control device according to the present embodiment. After the display control device is activated, one start pulse is externally input to the shift register 1. As a result, the shift register 1 outputs the shift pulses SCLK1 to SCLK(n) in series. In other words, based on the start pulse and the clock signal, the shift register 1 outputs the shift pulses SCLK1 to SCLK(n) in series to the n latch circuits of the data register 2, respectively.

At the same time, n gradation data (0Ah, 0Bh, . . . ) are input in series into the data register 102 of the data hold block 104 in synchronization with the clock signal. The n gradation data are digital data associated with respective output voltages S1 to Sn. As described above, each latch circuit of the data register 102 latches and holds the corresponding one gradation data at the time of the falling edge of the corresponding shift pulse as the latch signal LA. For example, the latch circuit to which the shift pulse SCLK1 is input latches the gradation data (0Ah) at the time when the shift pulse SCLK1 changes from "1" to "0", and keeps holding it. Similarly, the latch circuit to which the shift pulse SCLK2 is input latches the gradation data (0Bh) at the time when the shift pulse SCLK2 changes from "1" to "0", and keeps holding it. In this manner, the data register 102 latches respective gradation data in series in synchronization with the shift pulses SCLK1 to SCLK(n). As a result, the n gradation data associated with all the output voltage S1 to Sn are held by the data register 102.

While the data register 102 receives and takes in the gradation data, the strobe signal is set to "0". During this period, the data latch 103 is set in the data latch state (not in the data through state), and thus the electrical connection between the data register 102 and the data latch 103 is cut off. In other words, the gradation data stored in the data register 102 are not transferred to the data latch 103. After all the gradation data are latched by the data register 102, the strobe signal rises and changes from "0" to "1", as shown in FIG. 8. In response to that, the data register 102 and the data latch 103 are electrically connected with each other, and the data latch 103 receives all the gradation data held by the data register 102 simultaneously.

All the gradation data are transferred (supplied) from the data register 102 to the DA converter 5 through the data latch 103. Based on the reference voltage, the DA converter 5 converts the gradation data into the gradation voltages, respectively. The DA converter 5 outputs to the amplifier circuit 6 the gradation voltages corresponding to the respective gradation data. The amplifier circuit 6 amplifies the gradation voltages to generate the source output 7 (the output voltages S1 to Sn). Then, the amplifier circuit 6 applies the output voltages S1 to Sn to the respective data lines. As a consequence, representation of one line image is started in the display panel. After that, the strobe signal returns back to "0" and the data latch 103 becomes the data latch state again.

1-3. Effect

Figure 3:
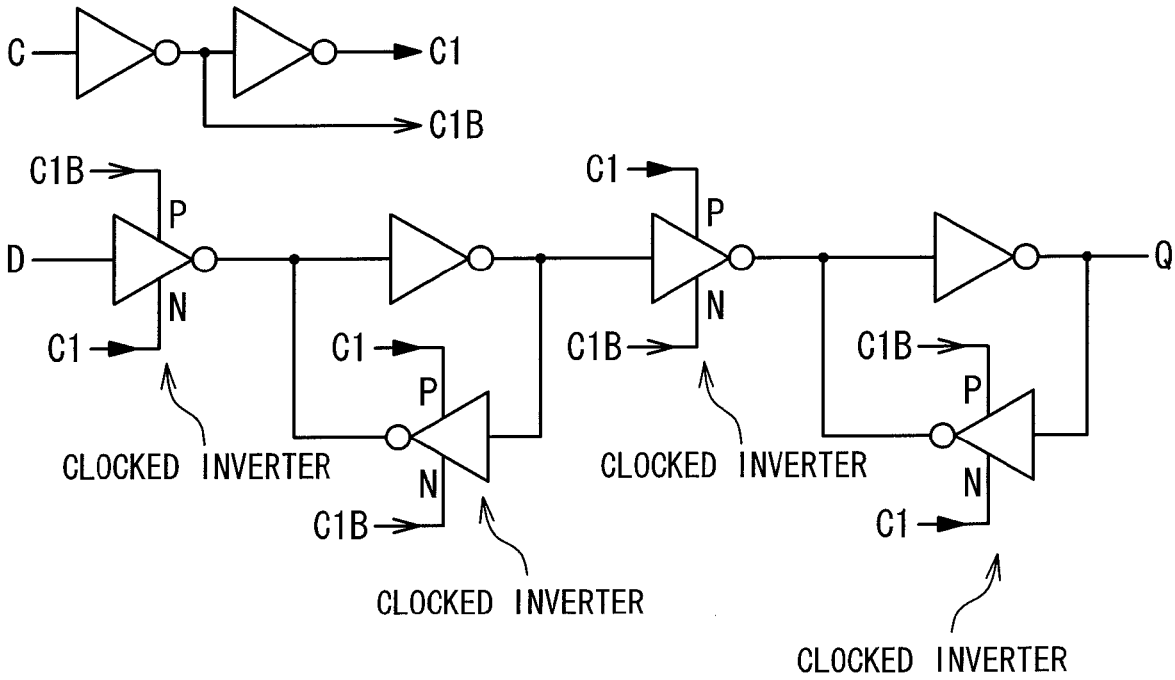
Fig. 3 PRIOR ART
FIG. 3 is a circuit diagram showing a configuration of a typical D flip-flop.

As described above, according to the present embodiment, the latch circuits instead of the conventional D flip-flops are employed in the data hold block 104. Even when the latch circuits are employed, the same functions and operations as in the conventional technique can be realized. It should be noted here that one latch circuit is half the size of one D flip-flop conventionally used, which is obvious from a comparison between FIG. 3 and FIG. 9. That is, the size of the data hold block 104 is reduced according to the present embodiment.

Figure 6:
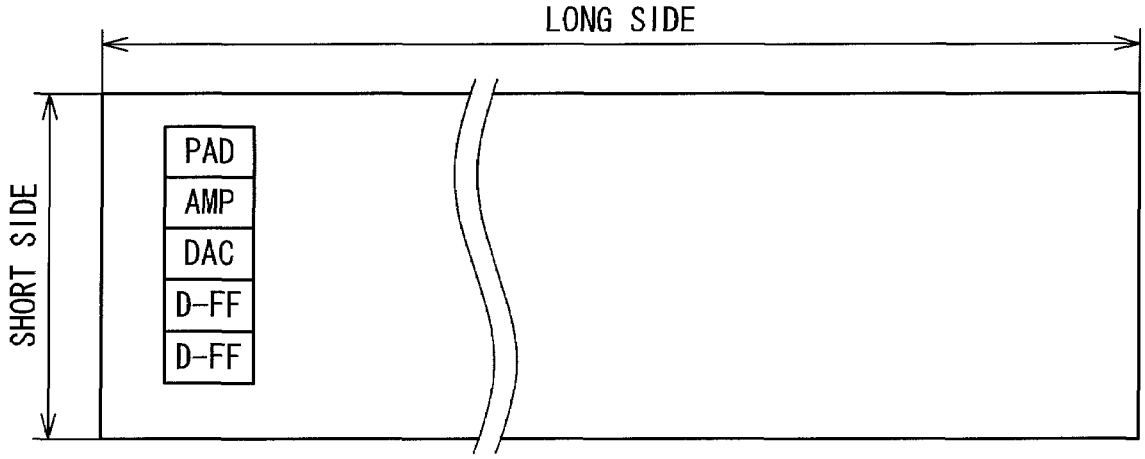
Fig. 6 PRIOR ART
FIG. 6 is a schematic diagram showing a layout of the conventional display control device.
Figure 10:
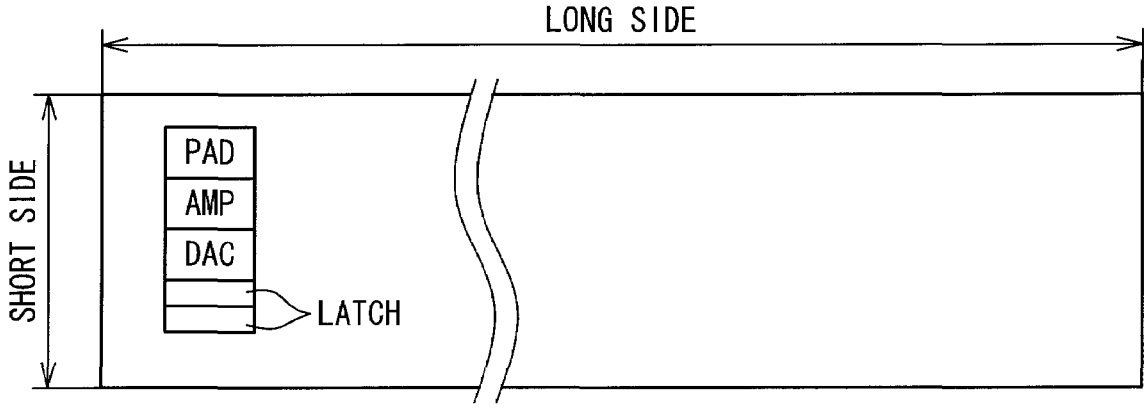
FIG. 10 is a schematic diagram showing a layout of the display control device according to the first embodiment of the present invention.

FIG. 10 shows an example of a layout of the display control device according to the present embodiment. As shown in FIG. 10, one pad (PAD), one amplifier circuit (AMP), one DA converter (DAC) and two latch circuits (Latch) are necessary for one source output. As is clear from a comparison between FIG. 6 and FIG. 10, the layout area of the display control device according to the present embodiment is reduced as compared with that in the conventional technique. In particular, the two latch circuits in FIG. 10 are placed along a direction parallel to the short side of the layout, and hence the layout area is reduced in the direction parallel to the short side. The reduction of the layout area along the short side is particularly effective for a reduction of the production cost.

According to the display control device of the present embodiment, as described above, the circuit layout area is reduced. As a result, the production cost of the display control device can be reduced. That is, it is possible to reduce the circuit layout area and the production cost with achieving the same functions and operations as in the conventional technique. In particular, the increase in the number of gradations in recent years tends to cause the increase in the circuit layout area of the display control device. According to the present embodiment, the increase in the circuit layout area and the production cost can be suppressed.

2. Second Embodiment 2-1. Configuration

Figure 11:
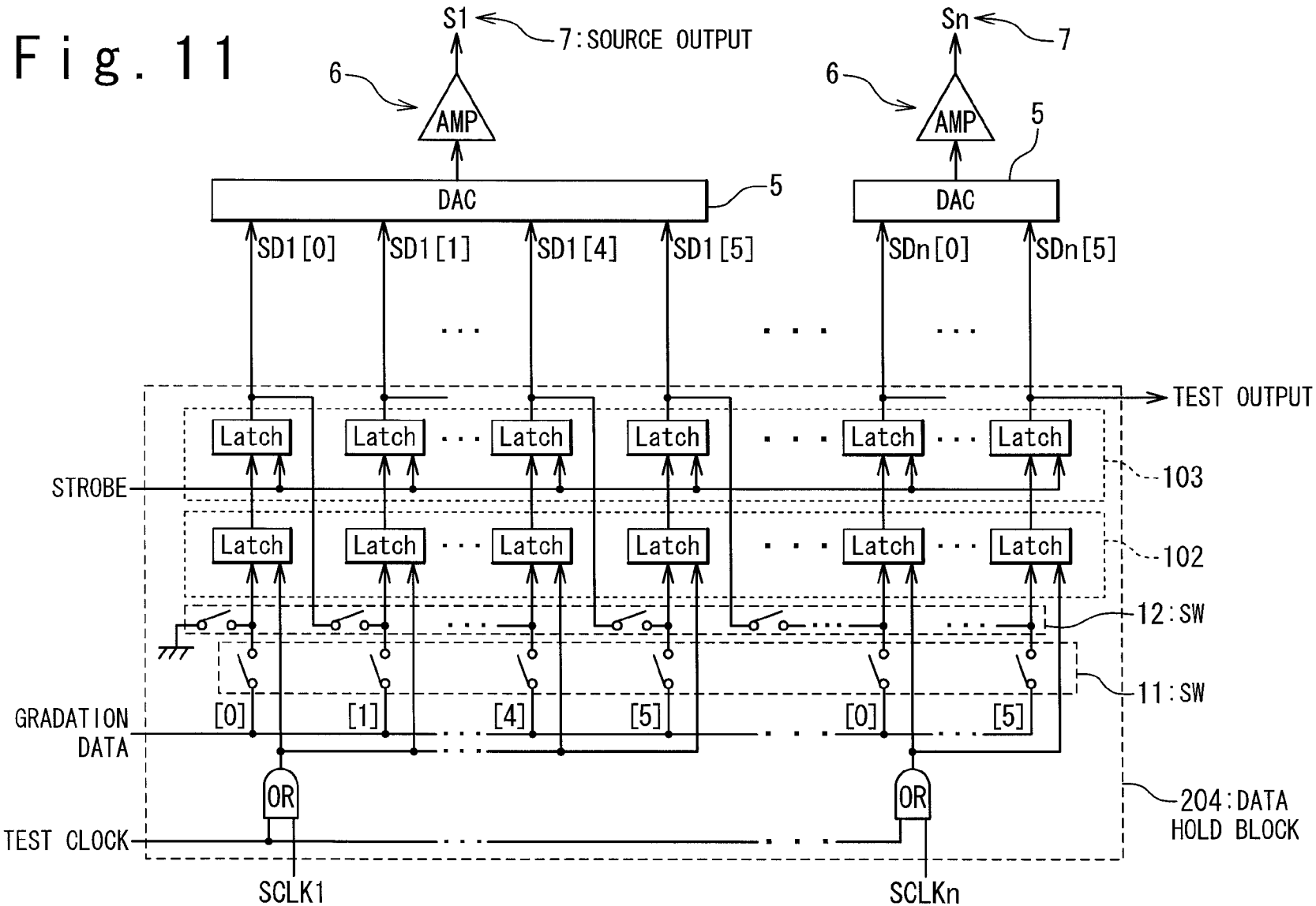
FIG. 11 is a block diagram showing a configuration of a display control device according to a second embodiment of the present invention.

FIG. 11 is a block diagram showing a configuration of a display control device according to a second embodiment of the present invention. The same reference numerals are given to the same components as those described in the first embodiment, and an overlapping description will be appropriately omitted.

The display control device according to the present embodiment is provided with a data hold block 204 instead of the data hold block 104 shown in the first embodiment. The data hold block 204 includes the data register 102 and the data latch 103 as in the first embodiment. That is, the data register 102 has the n latch circuits associated with the n gradation data (n source outputs S1 to Sn) respectively. Moreover, the data latch 103 has the n latch circuits associated with the n gradation data (n source outputs S1 to Sn) respectively.

It should be noted that FIG. 11 illustrates in detail the inside of one latch circuit (one Latch shown in FIG. 7) for latching one gradation data. In other words, a plurality of latch circuits associated with respective bits of one gradation data are shown in detail. Hereinafter, let us consider a case of 6 bits gradation data as an example. In this case, 6 bits gradation data SD1[0] to SD1[5] are output to one DA converter (DAC) from the data latch 103. The one DA converter converts the 6 bits gradation data SD1[0] to SD1[5] to a corresponding gradation voltage, and the gradation voltage is amplified by one amplifier circuit (AMP) to be the output voltage S1. Similarly, a DA converter (DAC) which receives 6 bits gradation data SDn[0] to SDn[5] generates a gradation voltage corresponding to it, and the gradation voltage is amplified by one amplifier circuit (AMP) to be the output voltage Sn.

In the present embodiment, the data hold block 204 is provided with n OR circuits. The n OR circuits are provided for the n latch circuits of the data register 102, respectively. More specifically, an output terminal of each OR circuit is connected to latch signal input terminals of the corresponding latch circuits. Input to respective input terminals of the n OR circuits are the shift pulses SCLK1 to SCLK(n) respectively. In addition, a test clock signal is input to the input terminals of the n OR circuits. In other words, each OR circuit receives the test clock signal and any of the shift pulses SCLK1 to SCLK (n), and outputs a result of the logical OR operation as the latch signal LA to the corresponding latch circuit. When the test clock signal is fixed at "0", each of the shift pulses SCLK1 to SCLK(n) is supplied as the latch signal LA to the corresponding latch circuit. On the other hand, when all the shift pulses are fixed at "0", the test clock signal is supplied as the latch signal LA to the latch circuits.

Moreover, the data hold block 204 according to the present embodiment is provided with a switch circuit (SW) 11. The switch circuit 11 is connected to the data input terminals D of the latch circuits of the data register 102. In this case, the gradation data are supplied to respective latch circuits of the data register 102 through the switch circuit 11. If the switch circuit 11 is turned OFF, the gradation data are not supplied to the data register 102.

Furthermore, the data hold block 204 according to the present embodiment is provided with a switch circuit (SW) 12 that includes a plurality of switches. In FIG. 11, the leftmost switch in the switch circuit 12 is connected between a ground terminal and a data input terminal D of the leftmost latch circuit in the data register 102. The second switch next to the leftmost switch in the switch circuit 12 is connected between a data output terminal Q of the leftmost latch circuit in the data latch 103 and a data input terminal D of the second latch circuit next to the leftmost latch circuit in the data register 102. Similarly, the j-th (j is an integer from 2 to n) switch in the switch circuit 12 is connected between a data output terminal Q of the (j−1)-th latch circuit in the data latch 103 and a data input terminal D of the j-th latch circuit in the data register 102. Therefore, when the switch circuit 12 is turned ON, the latch circuits in the data register 102 and the latch circuits in the data latch 103 are alternately connected in series. As describe later, such a connection forms "one shift register". The data output terminal Q of the rightmost latch circuit in the data latch 103, namely, an output of the "one shift register" is connected to a test output terminal.

2-2. Operation

In a normal operation mode, the test clock signal is not input into the data hold block 204. That is, the test clock signal is fixed at "0". Therefore, the shift pulses SCLK1 to SCLK(n) are respectively supplied to the corresponding latch circuits in the data register 102. Moreover, in the normal operation mode, the switch circuit 11 is turned ON, while the switch circuit 12 is turned OFF. In this case, the configuration of the data hold block 204 is similar to that in the first embodiment. Therefore, the same operation as in the first embodiment can be carried out (see FIG. 8).

In a test mode, a test of the data hold block 204 is carried out. In the test mode, all the gradation data associated with the source outputs 7 are first held by the data register 102. After that, the switch circuit 11 is turned OFF, while the switch circuit 12 is turned ON. In this case, no new gradation data is supplied to the data register 102, because the switch circuit 11 is turned OFF. On the other hand, since the switch circuit 12 is turned ON, the latch circuits in the data register 102 and the latch circuits in the data latch 103 are alternately connected in series. In the test mode, each latch circuit of the data register 102 executes a latch operation in synchronization with a test clock signal. Each latch circuit of the data latch 103 executes a latch operation in synchronization with a strobe signal.

Figure 12:
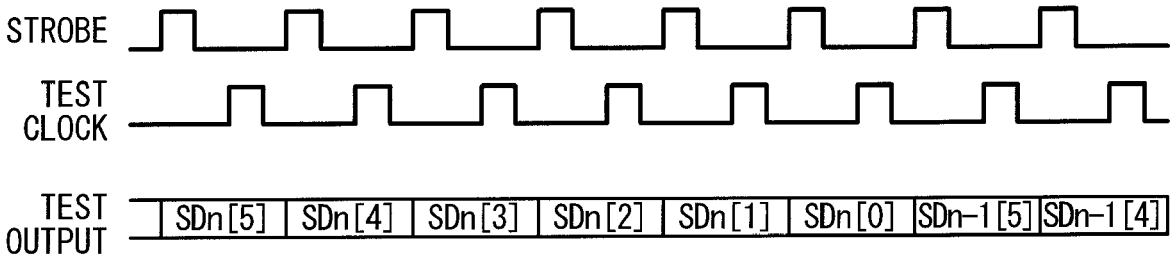
FIG. 12 is a timing chart showing an example of an operation of the display control device according to the second embodiment of the present invention.

FIG. 12 is a timing chart showing an example of an operation of the display control device at the time of the test mode. As shown in FIG. 12, one pulse of the strobe signal is first input. That is, the strobe signal changes from "0" to "1", and then changes from "1" to "0". In accordance with the rising edge of the strobe signal, the data output terminals Q of the latch circuits in the data register 102 are electrically connected to the data input terminals D of the latch circuits in the data latch 103, respectively. As a result, the gradation data are transferred from the data register 102 to the data latch 103. Consequently, the gradation data SDn[5] of one bit is output from the test output terminal. After that, the latch circuits in the data latch 103 latch the received gradation data respectively in accordance with the falling edge of the strobe signal.

Next, one pulse of the test clock signal is input. That is, the test clock signal changes from "0" to "1", and then changes from "1" to "0". In accordance with the rising edge of the test clock signal, the data output terminal Q of each latch circuit in the data latch 103 is electrically connected to the data input terminal D of the next-stage (right-hand) latch circuit in the data register 102. As a result, the gradation data are transferred from the data latch 103 to the data register 102. At this time, a bit of the gradation data held by each latch circuit in the data latch 103 is transferred to the next-stage (right-hand) latch circuit in the data register 102. After that, the latch circuits in the data register 102 latch the received gradation data respectively in accordance with the falling edge of the test clock signal.

Next, one pulse of the strobe signal in input again. As a result, the gradation data are transferred from the data register 102 to the data latch 103. At the same time, the gradation data SDn[4] of one bit is output from the test output terminal. After that, the test clock signal and the strobe signal are alternately input in a similar way, as shown in FIG. 12. As a consequence, the gradation data held by the data register 102 are output one bit by one bit in series through the test output terminal to the outside. In this manner, the latch circuits of the data register 102 and the latch circuits of the data latch 103 constitute one shift register in the test mode which operates in accordance with the strobe signal and the test clock signal in the test mode.

2-3. Effect

Figure 1:
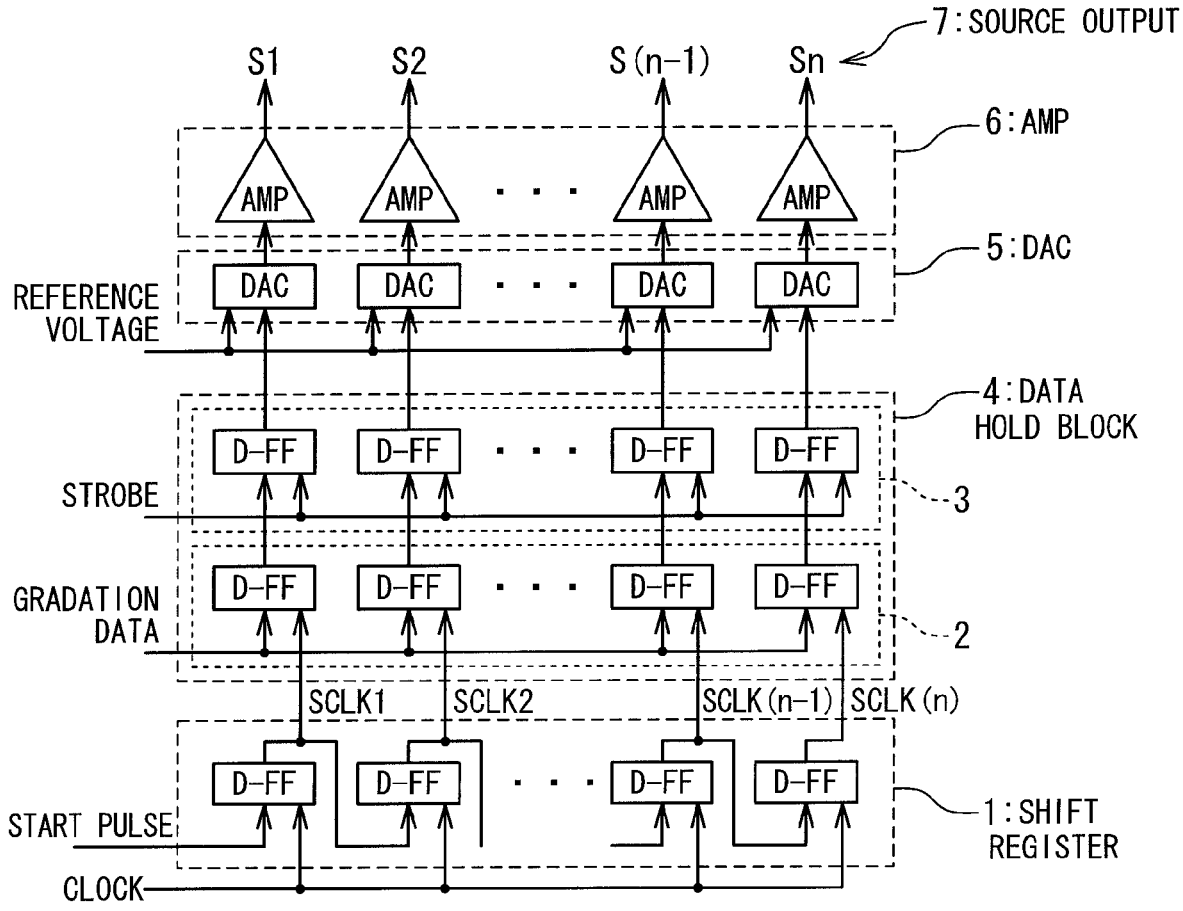
Fig. 1 PRIOR ART
FIG. 1 is a block diagram showing a configuration of a conventional display control device.
Figure 2:
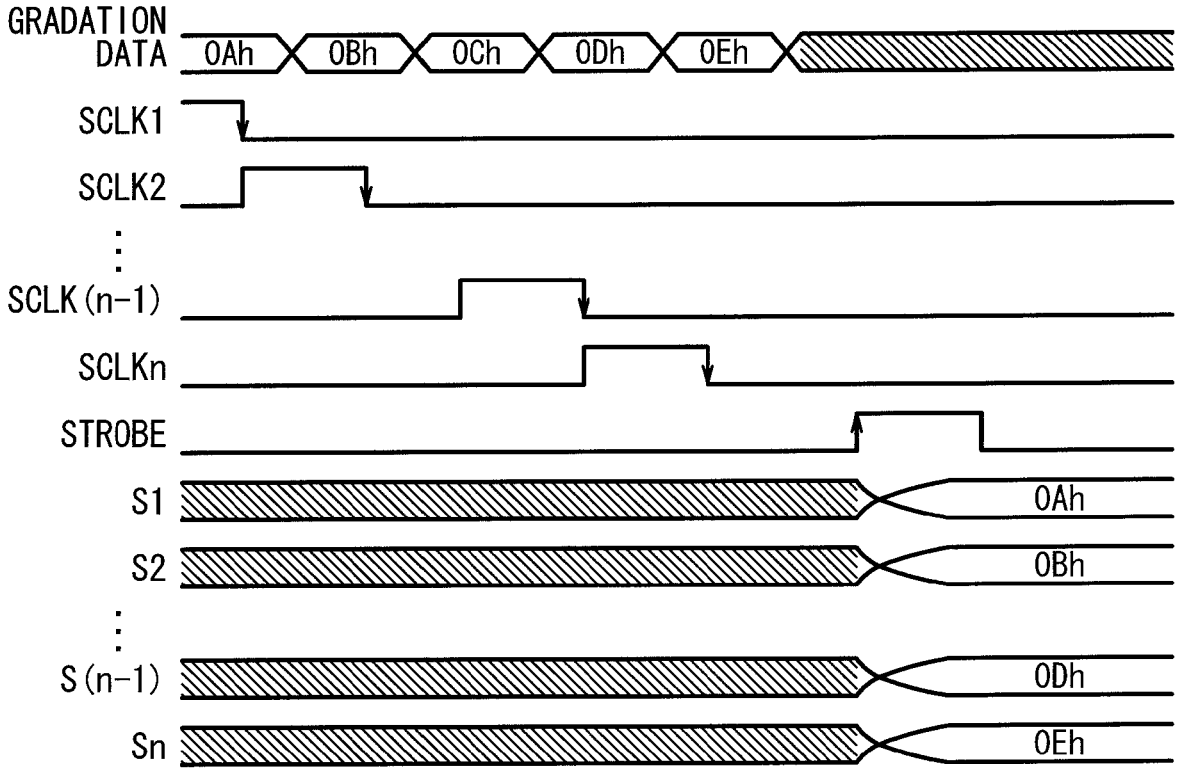
Fig. 2 PRIOR ART
FIG. 2 is a timing chart showing an operation of the conventional display control device.
Figure 4A:
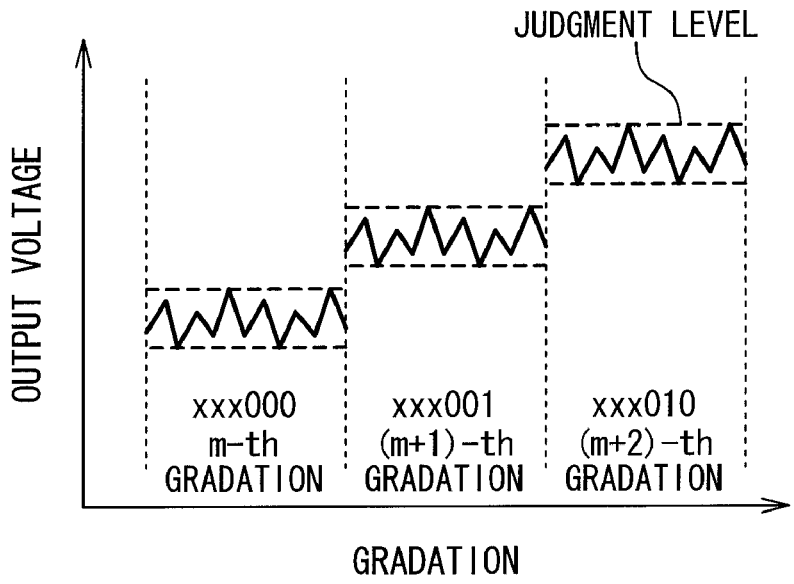
Fig. 4A PRIOR ART
FIG. 4A is a schematic diagram showing an example of source outputs by the conventional display control device.
Figure 4B:
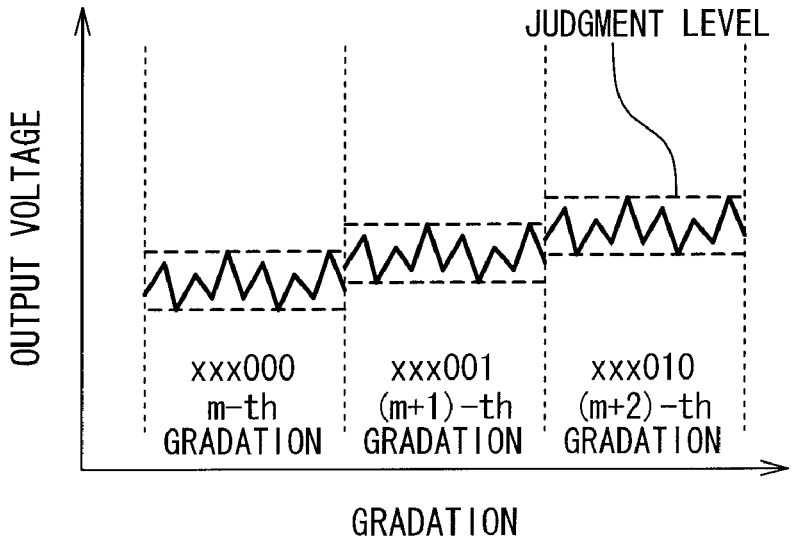
Fig. 4B PRIOR ART
FIG. 4B is a schematic diagram showing another example of source outputs by the conventional display control device.
Figure 5:
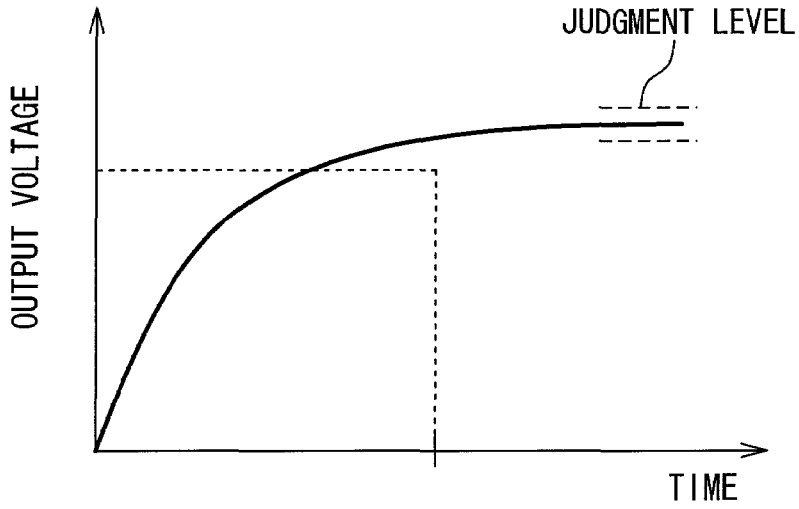
Fig. 5 PRIOR ART
FIG. 5 is a diagram showing a waveform of a source output (output voltage) by the conventional display control device.

According to the conventional technique shown in FIG. 1, in the test of the data hold block 4, various gradation data are written into the data hold block 4, and then the source outputs 7 output from the amplifier circuit 6 are analyzed. The source outputs 7 include the plurality of output voltages S1 to Sn as described above, and manufacturing variability or the like affects the output voltages S1 to Sn. Even if the same gradation data is written into all the D flip-flops of the data register 2, the analog output voltages S1 to Sn are not always equal to each other due to the manufacturing variability or the like. However, as shown in FIG. 4B, the difference between the judgment levels of the adjacent gradations is becoming smaller because of the increase in the number of gradations and decrease in the operation voltage. In this case, it is difficult to test the data hold block 4 by checking the gradation data based on the output voltages S1 to Sn.

According to the present embodiment, however, the latch circuits of the data register 102 and the latch circuits of the data latch 103 constitute one shift register in the test mode. The gradation data stored in the data register 102 are output one bit by one bit in series from the test output terminal. That is to say, it is possible to digitally carry out the test of the data hold block 204 based on the gradation data themselves instead of the source outputs 7. Therefore, it becomes easier to carry out the test of the data hold block 204, which is an additional effect as compared with the first embodiment. This also contributes to the reduction of the production cost of the display control device. It should be noted that both of the data register 102 and the data latch 103 are used in the test mode. Therefore, it can be said that all the latch circuits in both of the data register 102 and the data latch 103 are tested simultaneously.

3. Third Embodiment 3-1. Configuration

Figure 13:
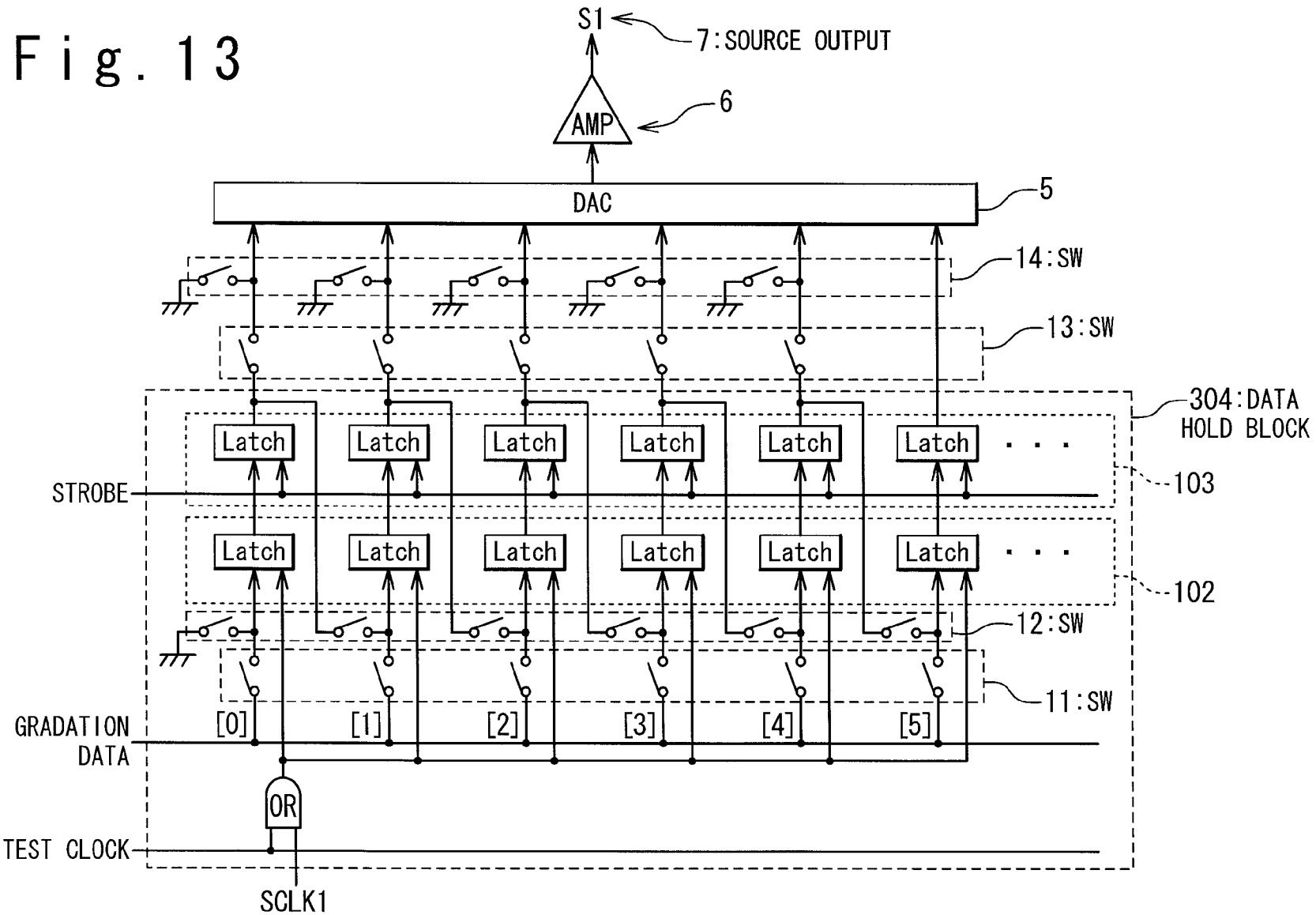
FIG. 13 is a block diagram showing a configuration of a display control device according to a third embodiment of the present invention.

FIG. 13 is a block diagram showing a configuration of a display control device according to a third embodiment of the present invention. The same reference numerals are given to the same components as those described in the foregoing embodiments, and an overlapping description will be appropriately omitted.

The display control device according to the present embodiment is provided with a data hold block 304 instead of the data hold block 104 shown in the first embodiment. The data hold block 304 has the same configuration as the data hold block 204 shown in the second embodiment. That is, the data hold block 304 includes the data register 102, the data latch 103, the OR circuits, the switch circuits 11 and 12. It should be noted that FIG. 13 illustrates in detail the inside of one latch circuit (one Latch shown in FIG. 7) for latching one gradation data associated with the output voltage S1. Hereinafter, let us consider a case of 6 bits gradation data as an example.

The data register 102 has the n latch circuits associated with the n gradation data (n source outputs S1 to Sn) respectively. Moreover, the data latch 103 has the n latch circuits associated with the n gradation data (n source outputs S1 to Sn) respectively. The switch circuit 11 is connected to the data input terminals D of the latch circuits of the data register 102. When the switch circuit 12 is turned ON, the latch circuits in the data register 102 and the latch circuits in the data latch 103 are alternately connected in series to form one shift register. In the present embodiment, the data output terminal Q of the rightmost latch circuit in the data latch 103 shown in FIG. 13, namely, the output of the one shift register is connected not to the above-mentioned test output terminal but to the DA converter 5.

Furthermore, the display control device according to the present embodiment is provided with a switch circuit (SW) 13 and a switch circuit (SW) 14 that are provided between the data hold block 304 and the DA converter 5. The data output terminals Q of the latch circuits of the data latch 103 are connected to the DA converter 5 through the switch circuit 13. When the switch circuit 13 is turned OFF, an electric connection between the data latch 103 and the DA converter 5 is basically cut off. Only the data output terminal Q of the rightmost latch circuit in the data latch 103 shown in FIG. 13, namely, the output terminal of the one shift register in the test mode is always electrically connected to the DA converter 5. The switch circuit 14 is provided between a ground terminal and input terminals of the DA converter 5. When the switch circuit 14 is turned ON, the input terminals of the DA converter 5 except for an input terminal for receiving an output signal from the one shift register in the test mode are connected to the ground.

3-2. Operation

In a normal operation mode, the test clock signal is not input into the data hold block 304. That is, the test clock signal is fixed at "0". Therefore, the shift pulses SCLK1 to SCLK(n) are respectively supplied to the corresponding latch circuits in the data register 102. Moreover, in the normal operation mode, the switch circuit 11 is turned ON, while the switch circuit 12 is turned OFF. In this case, the configuration of the data hold block 304 is similar to that in the first embodiment. Furthermore, the switch circuit 13 is turned ON, while the switch circuit 14 is turned OFF. Therefore, the same operation as in the first embodiment can be carried out (see FIG. 8).

In a test mode, a test of the data hold block 304 is carried out. In the test mode, all the gradation data associated with the source outputs 7 are first held by the data register 102. After that, the switch circuit 11 is turned OFF, while the switch circuit 12 is turned ON. In this case, no new gradation data is supplied to the data register 102, because the switch circuit 11 is turned OFF. On the other hand, since the switch circuit 12 is turned ON, the latch circuits in the data register 102 and the latch circuits in the data latch 103 are alternately connected in series to constitute the one shift register. Furthermore, in the test mode, the switch circuit 13 is turned OFF, while the switch circuit 14 is turned ON. Therefore, the output of the one shift register is input to the DA converter 5. In the test mode, each latch circuit of the data register 102 executes a latch operation in synchronization with a test clock signal. Each latch circuit of the data latch 103 executes a latch operation in synchronization with a strobe signal.

Figure 14:
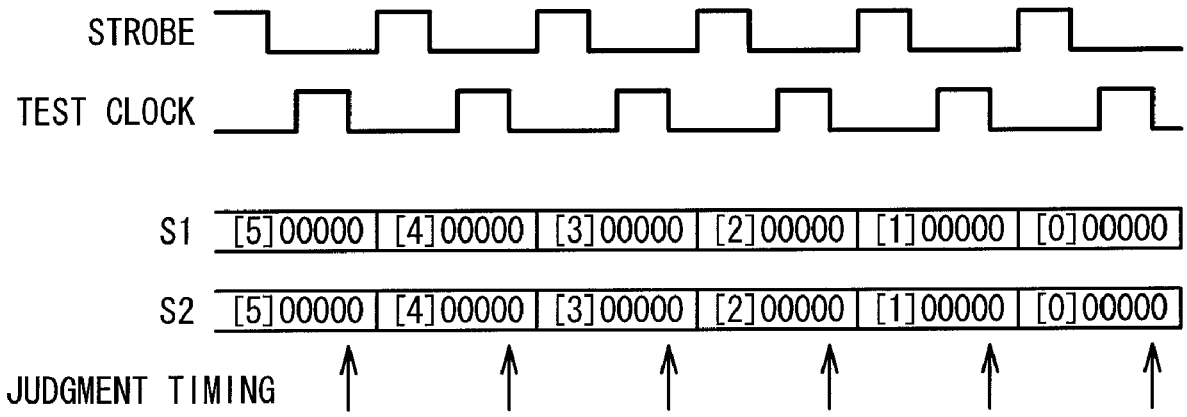
FIG. 14 is a timing chart showing an example of an operation of the display control device according to the third embodiment of the present invention.

FIG. 14 is a timing chart showing an example of an operation of the display control device at the time of the test mode. As shown in FIG. 14, one pulse of the strobe signal is first input. That is, the strobe signal changes from "0" to "1", and then changes from "1" to "0". In response to that, the gradation data are transferred from the data register 102 to the data latch 103, as in the second embodiment. As a result, a bit[5] of the gradation data is output from the rightmost latch circuit in the data latch 103 and input into one DA converter 5 (DAC). The other bits input to the one DA converter 5 (DAC) are "0" corresponding to the ground potential. Therefore, a 6-bits digital data input to the one DA converter 5 is "[5]00000". In a case when the bit[5] of the gradation data is "1", a 6-bits digital data of "100000" is input into the one DA converter 5. On the other hand, when the bit[5] of the gradation data is "0", a 6-bits digital data of "000000" is input into the one DA converter 5. The DA converter 5 converts the received digital data to a corresponding gradation voltage. The generated gradation voltage is amplified by the amplifier circuit 6, and then output as the output voltage (the output voltage S1 in FIG. 13).

Next, one pulse of the test clock signal is input. That is, the test clock signal changes from "0" to "1", and then changes from "1" to "0". In response to that, a bit of the gradation data held by each latch circuit in the data latch 103 is transferred to the next-stage (right-hand) latch circuit in the data register 102. Subsequently, one pulse of the strobe signal is input again. As a result, the gradation data are transferred from the data register 102 to the data latch 103. At this time, a bit[4] of the gradation data is output from the rightmost latch circuit in the data latch 103 and input into the one DA converter 5. In other words, a 6-bits digital data input to the one DA converter 5 is "[4]00000".

After that, the test clock signal and the strobe signal are alternately input in a similar way, as shown in FIG. 14. As a consequence, the gradation data held by the data register 102 are output one bit by one bit in series to the one DA converter 5. Each digital data input to the one DA converter 5 is either "100000" or "000000". The DA converter 5 converts the received digital data to a corresponding gradation voltage. The generated gradation voltage is amplified by the amplifier circuit 6, and then output as the output voltage.

According to the present embodiment, as described above, the 6-bits digital data input to the DA converter 5 is any of "100000" and "000000". In other words, a high-order bit of the digital data is the output of the one shift register (data hold block 304), while low-order bits of the digital data are fixed to a predetermined value ("0").

3-3. Effect

Figure 15:
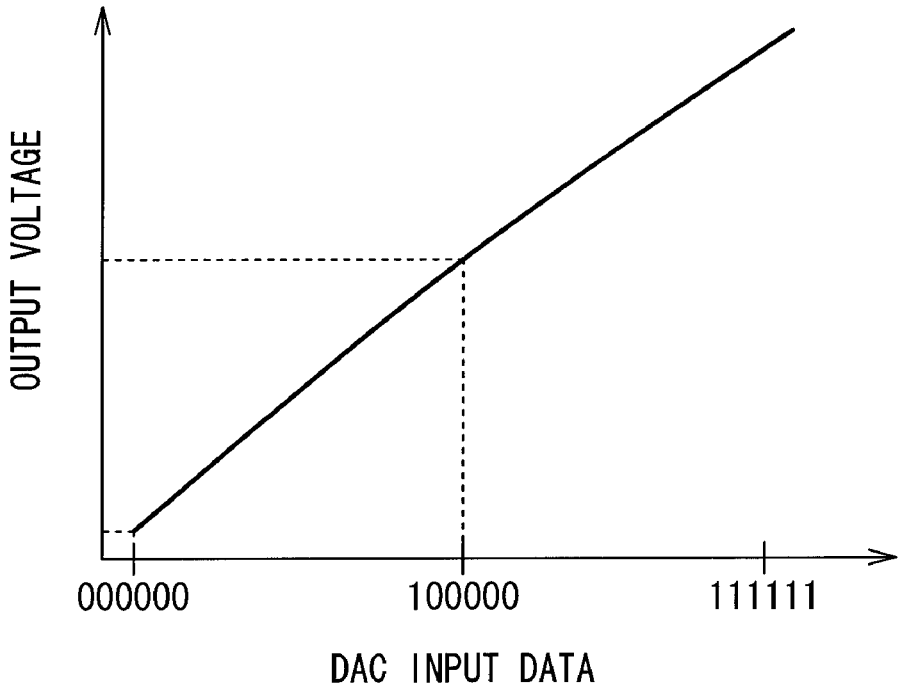
FIG. 15 is a graph showing a relationship between output voltages and input data to a DA converter in the display control device according to the third embodiment of the present invention.

FIG. 15 is a graph showing a relationship between the output voltage and the digital data input to the DA converter 5. As mentioned above, the digital data input to the DA converter 5 is either "1000001" or "000000". Therefore, the output voltage becomes any of two values. A difference between the two output voltages is half the power supply voltage. Therefore, it is easy to identify the digital data on the basis of the output voltage. In other words, it is easy to identify each bit of the gradation data held by the data hold block 304. That is to say, it is easy to test the gradation data held by the data hold block 304 based on the output voltages. This is an additional effect as compared with the first embodiment.

Figure 16:
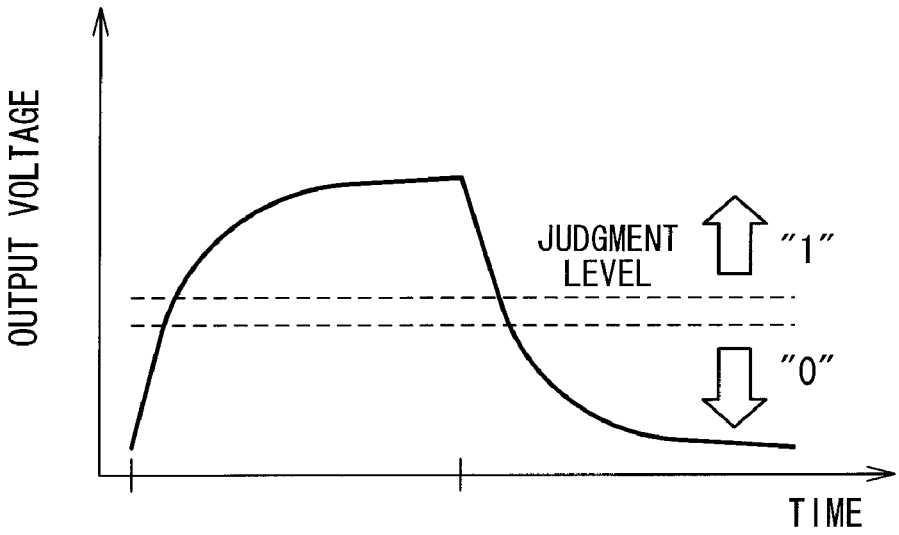
FIG. 16 is a diagram showing an example of a source output (output voltage) by the display control device according to the third embodiment of the present invention.

FIG. 16 shows an example of a time variation of the output voltage (source output) output from the amplifier circuit 6. As shown in FIG. 16, since the difference between the two output voltages is half the power supply voltage, it is possible to set the judgment level wider as compared with the conventional technique. Accordingly, it is not necessary to enhance the driving ability of the amplifier circuit 6, which can suppress electric power consumption. It is possible to judge the output voltage in a short period of time without increasing the driving ability of the amplifier circuit 6. In this manner, it is possible in the test mode to judge the gradation data held by the data hold block 304 easily and quickly.

Moreover, according to the present embodiment, it is not necessary to provide a test-dedicated output terminal. By setting the low-order bits of the digital data input to the DA converter 5 to a predetermined value, it is possible to precisely test the data hold block 304 on the basis of the source outputs 7, which is another additional effect.

It should be noted that the configuration of the switch circuit 14 is not limited to the above-described configuration where the switch circuit 14 is connected to the ground. For example, the switch circuit 14 may be connected to a power supply. In this case, a 6-bits digital data input into the DA converter 5 is either "111111" or "0111111". Even in this case, the same effect can be obtained. Alternatively, the data output terminal Q of the rightmost latch circuit in the data latch 103 shown in FIG. 13 may be connected to all the input terminals of the one DA converter 5. In this case, a 6-bits digital data input into the DA converter 5 is either "111111" or "000000". In this case, the difference between the two output voltages output from the amplifier circuit 6 takes a maximum value equal to the power supply voltage, and thus the testability is further improved.

4. Fourth Embodiment

Figure 17:
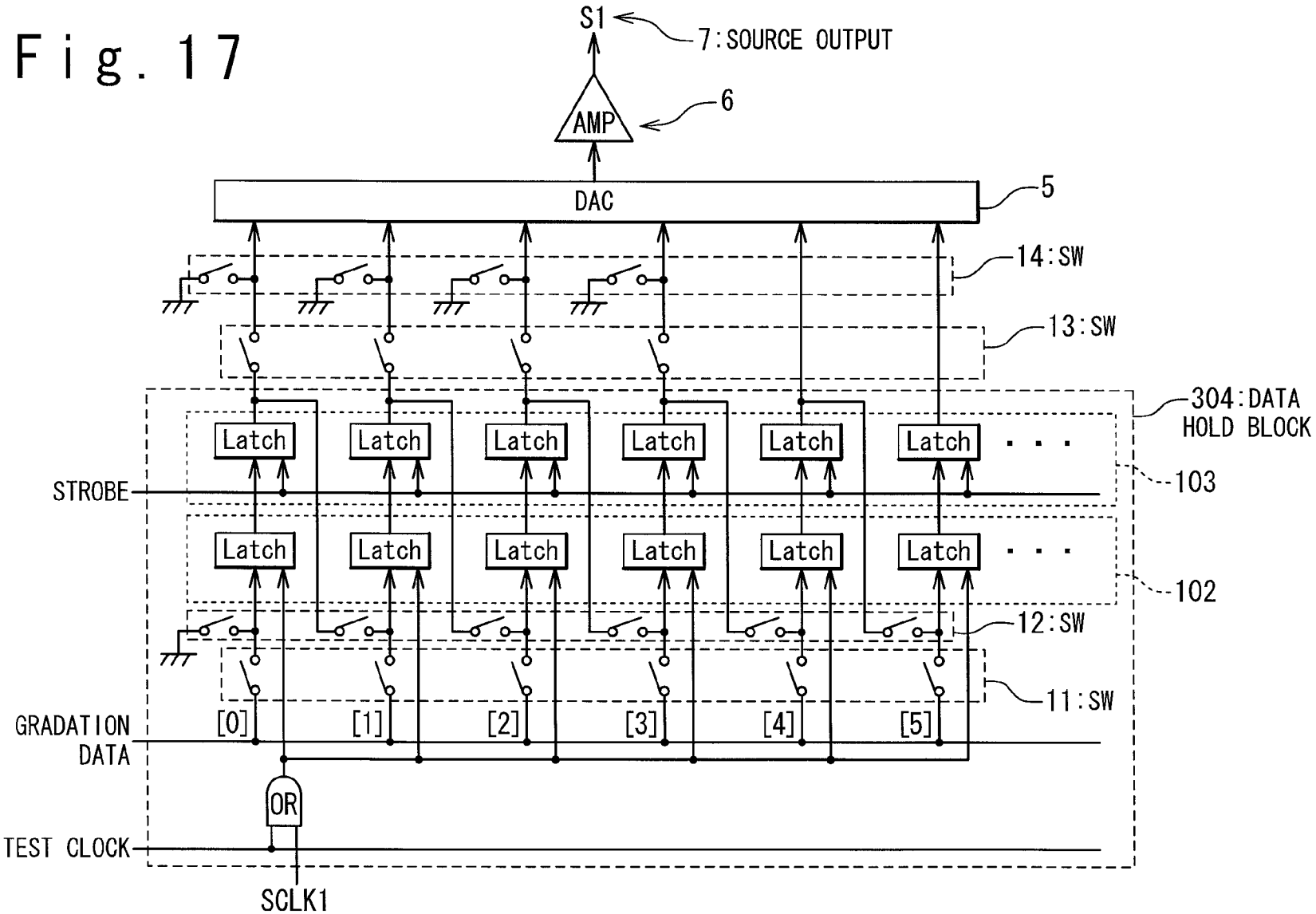
FIG. 17 is a block diagram showing a configuration of a display control device according to a fourth embodiment of the present invention.
Figure 18:
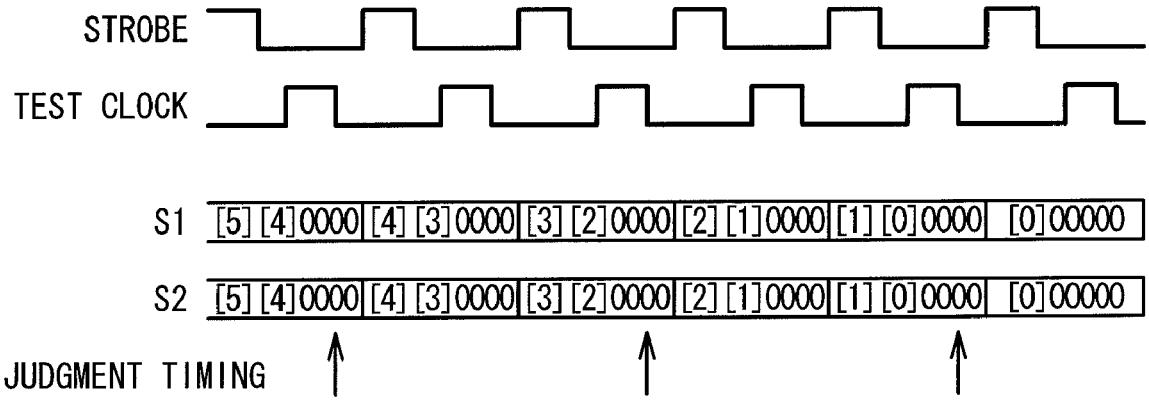
FIG. 18 is a timing chart showing an example of an operation of the display control device according to the fourth embodiment of the present invention.

FIG. 17 is a block diagram showing a configuration of a display control device according to a fourth embodiment of the present invention. FIG. 18 is a timing chart showing an example of an operation of the display control device at the time of the test mode. The same reference numerals are given to the same components as those described in the foregoing embodiments, and an overlapping description will be appropriately omitted.

The configuration and the operation according to the present embodiment are basically similar to those in the foregoing third embodiment. In the foregoing third embodiment, the one high-order bit of the digital data input into the DA converter 5 in the test mode is supplied from the data latch 103. In the present embodiment, the two high-order bits of the digital data input into the DA converter 5 in the test mode are simultaneously supplied from the data latch 103, as shown in FIGS. 17 and 18. Therefore, the output voltage output from the amplifier circuit 6 can take four different values. By testing every two bits, it is possible to reduce the number of judgments to half as compared with the third embodiment. Similarly, more than two high-order bits can be simultaneously supplied from the data latch 103 in the test mode. In this case, the number of judgments is further reduced.

According to the present embodiment, the same effects as in the third embodiment can be obtained. Furthermore, it is possible to reduce the number of judgments of the gradation data (output voltage) in the test mode.

It is apparent that the present invention is not limited to the above embodiment and may be modified and changed without departing from the scope and spirit of the invention.

What is claimed is:

1. A display control device comprising:

a shift register configured to generate n shift pulses (n is a natural number) in series in synchronization with a clock signal;

a data hold block configured to hold n gradation data that are digital data corresponding to an image displayed on a display panel; and a DA converter configured to convert said n gradation data into corresponding gradation voltages respectively, wherein said data hold block has:

n first latch circuits configured to respectively latch said n gradation data in series in synchronization with said n shift pulses; and n second latch circuits provided between said DA converter and said n first latch circuits respectively, wherein an electrical connection between said n first latch circuits and said n second latch circuits is cut off while said n first latch circuits receive said n gradation data respectively, and said n gradation data are simultaneously supplied to said DA converter from said n first latch circuits through said n second latch circuits after said n first latch circuits finish latching all of said n gradation data.

2. The display control device according to claim 1, wherein one of said n first latch circuits and one of said n second latch circuits which latch a same one of said n gradation data are placed along a direction parallel to a short side of the display control device.

3. The display control device according to claim 1, wherein in a test mode, said n first latch circuits and said n second latch circuits are alternately connected in series to form one shift register.

4. The display control device according to claim 3, wherein said data hold block further has:

a first switch circuit; and a second switch circuit, wherein said n gradation data are respectively supplied to said n first latch circuits through said first switch circuit under a condition that said first switch circuit is turned on and said second switch circuit is turned off, wherein in said test mode, said first switch circuit is turned off, and said second switch circuit is turned on such that said n first latch circuits and said n second latch circuits are alternately connected in series to form said one shift register.

5. The display control device according to claim 3, wherein each of said n first latch circuits is configured to execute a latch operation in synchronization with a test clock signal, while each of said n second latch circuits is configured to execute a latch operation in synchronization with a strobe signal, wherein in said test mode, said test clock signal and said strobe signal are input alternately.

6. The display control device according to claim 5, wherein in said test mode, said n gradation data are output one bit by one bit in series from said one shift register to an outside through a test output terminal.

7. The display control device according to claim 5, wherein in said test mode, said n gradation data are output one bit by one bit in series from said one shift register to said DA converter.

8. The display control device according to claim 7, wherein in said test mode, a high-order bit of a digital data input to said DA converter is said output of said one shift register, and a low-order bit of said digital data is fixed to a predetermined value.

* * * * *